US010231069B2

(12) United States Patent
Roeck et al.

(10) Patent No.: US 10,231,069 B2
(45) Date of Patent: Mar. 12, 2019

(54) METHOD FOR EVALUATING AN INDIVIDUAL HEARING BENEFIT OF A HEARING DEVICE FEATURE AND FOR FITTING A HEARING DEVICE

(71) Applicant: Sonova AG, Stafa (CH)

(72) Inventors: Hans-Ueli Roeck, Hombrechtikon (CH); Hubert Lechner, Zurich (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 15/318,736

(22) PCT Filed: Jun. 16, 2014

(86) PCT No.: PCT/EP2014/062542
§ 371 (c)(1),
(2) Date: Dec. 14, 2016

(87) PCT Pub. No.: WO2015/192870
PCT Pub. Date: Dec. 23, 2015

(65) Prior Publication Data

US 2017/0127201 A1 May 4, 2017

(51) Int. Cl.
*H04R 25/00* (2006.01)

(52) U.S. Cl.
CPC ..... *H04R 25/70* (2013.01); *H04R 25/505* (2013.01); *H04R 25/558* (2013.01); *H04R 25/552* (2013.01); *H04R 2225/41* (2013.01)

(58) Field of Classification Search
CPC ..... H04R 25/558; H04R 2225/39; H04R 2225/55
See application file for complete search history.

(56) References Cited

U.S. PATENT DOCUMENTS 7,671,756 B2 * 3/2010 Herz ..... G06F 3/017 340/539.1
8,165,329 B2 * 4/2012 Bisgaard ..... H04R 25/505 381/312

(Continued)

FOREIGN PATENT DOCUMENTS

WO 2006/002035 A2 1/2006
WO 2007/039649 A2 4/2007

OTHER PUBLICATIONS

International Search Report for PCT/EP2014/062542 dated Feb. 12, 2015.
Written Opinion for PCT/EP2014/062542 dated Feb. 12, 2015.

*Primary Examiner* — Curtis A Kuntz
*Assistant Examiner* — Ryan Robinson
(74) *Attorney, Agent, or Firm* — Pearne & Gordon LLP

(57) ABSTRACT

A method for evaluating an individual hearing benefit of an advanced hearing device feature, including providing a basic and an advanced hearing device feature in a hearing device, automatically classifying a current hearing situation, automatically selecting the advanced hearing device feature dependent on the classified hearing situation, applying the selected advanced hearing device feature for processing an audio signal, providing the processed audio signal to an output transducer of the hearing device, indicating to the user that the advanced hearing device feature is currently being applied, and providing a control for the user to switch off and on an effect of the second hearing device feature.

18 Claims, 1 Drawing Sheet

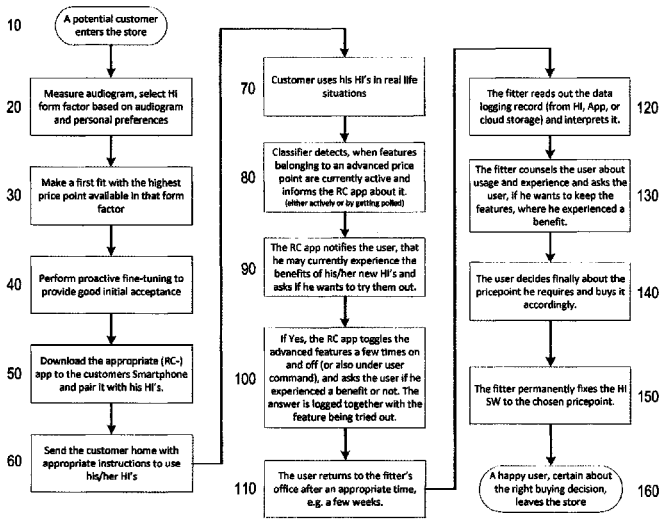

(56) References Cited

U.S. PATENT DOCUMENTS

| | | | | |
|---|---|---|---|---|
| 8,761,421 | B2 * | 6/2014 | Apfel | H04R 25/70 381/313 |
| 8,767,986 | B1 * | 7/2014 | Fabry | H04R 25/70 381/314 |
| 9,173,043 | B2 * | 10/2015 | Bulow | H04R 25/70 |
| 9,723,415 | B2 * | 8/2017 | Gran | H04R 25/70 |
| 9,794,699 | B2 * | 10/2017 | Choi | H04R 25/43 |
| 2009/0196448 | A1 | 8/2009 | Schumaier | |
| 2013/0343583 | A1 | 12/2013 | Marcoux | |
| 2016/0174000 | A1 * | 6/2016 | Ungstrup | H04R 25/554 381/315 |
| 2016/0330554 | A1 * | 11/2016 | Hillbratt | H04R 25/558 |
| 2016/0350821 | A1 * | 12/2016 | Shennib | G06Q 30/0601 |
| 2017/0118565 | A1 * | 4/2017 | Nielsen | H04R 25/70 |
| 2017/0230769 | A1 * | 8/2017 | Nguyen | H04R 25/558 |

* cited by examiner

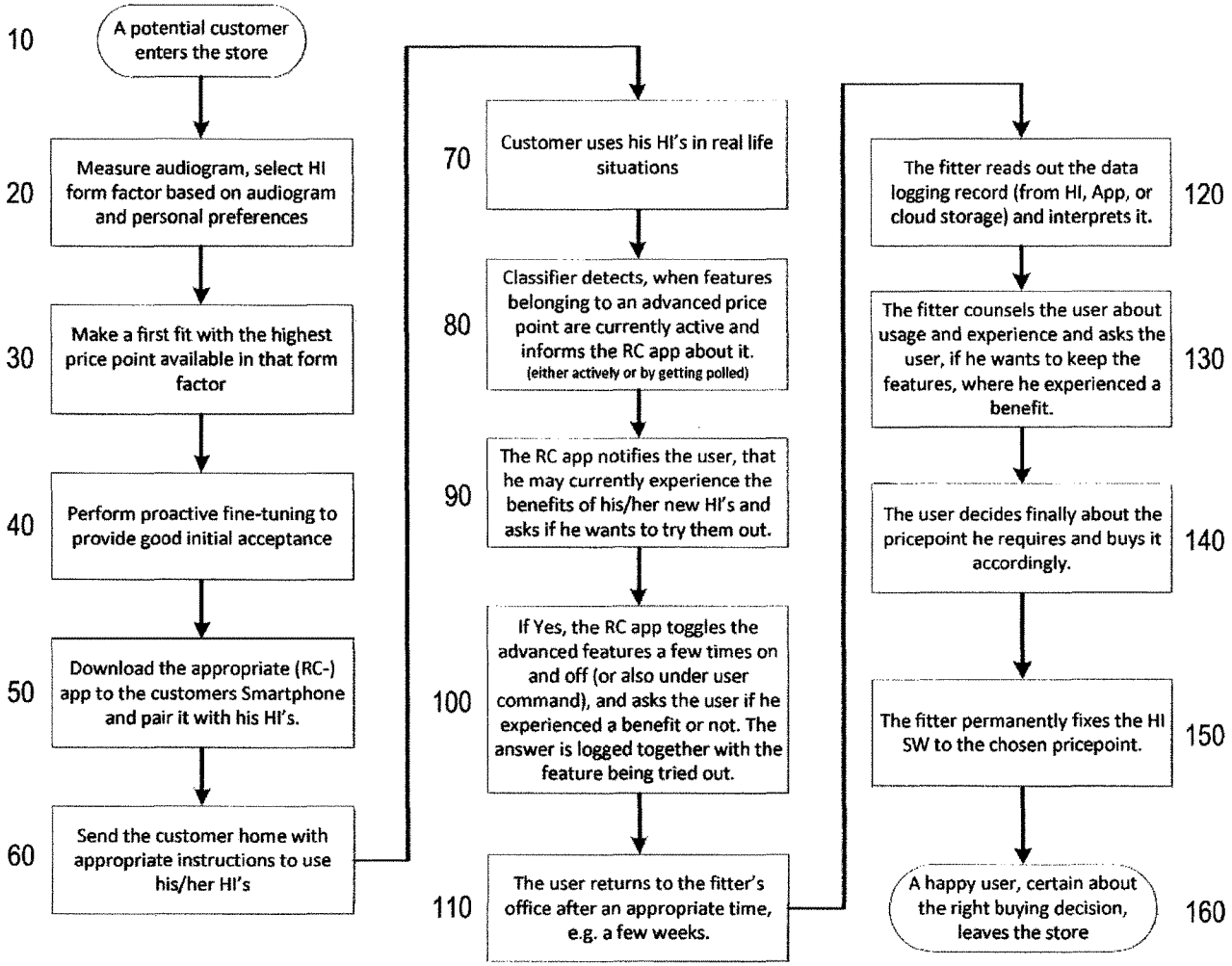
10
A potential customer enters the store
20
Measure audiogram, select HI form factor based on audiogram and personal preferences
30
Make a first fit with the highest price point available in that form factor
40
Perform proactive fine-tuning to provide good initial acceptance
50
Download the appropriate (RC-) app to the customers Smartphone and pair it with his HI's.
60
Send the customer home with appropriate instructions to use his/her HI's
70
Customer uses his HI's in real life situations
80
Classifier detects, when features belonging to an advanced price point are currently active and informs the RC app about it.
(either actively or by getting polled)
90
The RC app notifies the user, that he may currently experience the benefits of his/her new HI's and asks if he wants to try them out.
100
If Yes, the RC app toggles the advanced features a few times on and off (or also under user command), and asks the user if he experienced a benefit or not. The answer is logged together with the feature being tried out.
110
The user returns to the fitter's office after an appropriate time, e.g. a few weeks.
120
The fitter reads out the data logging record (from HI, App, or cloud storage) and interprets it.
130
The fitter counsels the user about usage and experience and asks the user, if he wants to keep the features, where he experienced a benefit.
140
The user decides finally about the pricepoint he requires and buys it accordingly.
150
The fitter permanently fixes the HI SW to the chosen pricepoint.
160
A happy user, certain about the right buying decision, leaves the store

METHOD FOR EVALUATING AN INDIVIDUAL HEARING BENEFIT OF A HEARING DEVICE FEATURE AND FOR FITTING A HEARING DEVICE

TECHNICAL FIELD

The present invention pertains to a method for evaluating an individual benefit of a hearing device feature and for fitting a hearing device.

BACKGROUND OF THE INVENTION

Hearing devices such as hearing aids (also referred to as hearing prostheses or hearing instruments) for hard of hearing people or hearing enhancement devices for augmenting the hearing capability of normal hearing persons, as well as hearing protection devices designed to prevent noise-induced hearing loss, commonly comprise an input transducer, e.g. a microphone, for picking up sound from the surroundings, a signal processing unit for processing the signal from the input transducer, and an output transducer, e.g. a miniature loudspeaker also called a receiver, for converting the processed signal into a signal perceivable by the user of the hearing device. Typically such hearing devices are adapted to be worn at the ear (e.g. a behind-the-ear, BTE hearing device) or within the ear canal (e.g. an in-the-ear, ITE or completely-in-canal, CIC hearing device), or alternatively be partly anchored in the scull (e.g. a bone-anchored hearing aid, BAHA) or partly implanted in the middle or inner ear (e.g. a direct acoustic cochlear stimulation, DACS, or cochlear implant). Furthermore, such hearing devices commonly incorporate a number of different functionalities or features, which provide a range of benefits to the user and allow to improve the user's hearing experience to various degrees. Usually, some basic features are provided in all hearing devices, whereas advanced features, for instance employing more sophisticated audio signal processing such as adaptive beamforming and binaural signal processing, or providing more complex functionalities such as wireless audio streaming, are only offered by high-end hearing devices, which are therefore more expensive. A hearing device professional, such as an audiologist or hearing aid acoustician, often referred to a hearing device "fitter", will select a suitable hearing device model along with appropriate features depending on the needs and preferences of a certain user. In order to demonstrate the benefits and usefulness of the selected hearing device(s) and especially of the chosen features the audiologist commonly plays back recorded sound samples associated with a limited number of standard hearing situations via a loudspeaker setup located at the audiologist's office to the user wearing the selected hearing device(s). Unfortunately, this is a very tedious process and it is often difficult to show the benefit of certain features to the user in such artificial surroundings. Consequently, the user will often be hesitant to invest in a certain feature when he is not fully convinced of its usefulness in his everyday life.

SUMMARY OF THE INVENTION

It is therefore an object of the present invention to support the process of acquiring a hearing device that provides a desired level of usefulness to its user and thus results in a high level of user satisfaction.

This object is achieved by the method for evaluating an individual benefit of a hearing device feature according to claim 1. Specific embodiments of the proposed method are provided in the dependent claims 2 to 15.

The present invention provides a method for evaluating an individual hearing benefit of an advanced hearing device feature, comprising:

a) providing at least one first, basic hearing device feature in a hearing device;

b) providing at least one second, advanced hearing device feature in the hearing device, wherein the at least one advanced hearing device feature is designed to provide a benefit to a user of the hearing device in certain hearing situations beyond the at least one basic hearing device feature, for instance to provide improved hearing ability to the user;

c) automatically classifying a current hearing situation (i.e. a current acoustic environment);

d) automatically selecting the at least one second hearing device feature dependent on the classified hearing situation;

e) applying the selected at least one second hearing device feature for processing an audio signal, e.g. derived from at least one microphone of the hearing device and/or from a (e.g. wireless) signal received by the hearing device;

f) providing the processed audio signal to an output transducer (e.g. a loudspeaker/receiver) of the hearing device;

g) indicating to the user that the at least one second hearing device feature (has been selected and) is currently being applied; and h) providing control means for the user to (temporarily) switch off and on an effect of the at least one second hearing device feature.

In particular the control means are adapted such that when the user switches off the at least one second hearing device feature the at least one first hearing device feature is switched on, and when the user switches on the at least one second hearing device feature the at least one first hearing device feature is switched off. However, it should be noted that basic and advanced features can be applied concurrently (i.e. simultaneously), so that when an advanced feature is turned off it is not necessary to turn on a basic feature to replace the advanced feature. For instance a basic feature could be frequency dependent amplification for compensation of a frequency dependent hearing loss, which is active all the time when the hearing device is in use. To demonstrate an effect of an additional, advanced feature such as adaptive beamforming would simply require switching on and off the adaptive beamformer, whilst the frequency dependent amplification remains active independent of whether adaptive beamforming is presently being applied or not.

By employing the proposed method the user is given a chance to consciously experience the benefits of advanced features as provided in higher priced hearing device models without the financial obligation of buying them right away, and without the audiologist having to try to demonstrate these benefits in his office or right outside of his office. Because normally the user is not aware when advanced features that are not permanently applied but only in certain hearing situations are actually in effect, just using a hearing device over a period of time, e.g. for some weeks, and employing an advanced feature when the user is not aware thereof is not sufficient to get a good understanding and own impression of the feature's benefit. Therefore, according to the present invention it is indicated to the user that an advanced hearing device feature is presently being applied (and thus that the current acoustic situation is suitable for experiencing the benefit of the advanced feature), and more-over, a control means is provided for the user to turn off and on the feature in order to be able to compare the perception of the current personal, real-life hearing situation when the feature is being used and when it is turned off, thus allowing the user to consciously form a personal opinion regarding the benefit of the feature.

In an embodiment the method further comprises the step b') of adjusting the at least one first and the at least one second hearing device feature to the individual hearing preferences and/or hearing requirements of a user of the hearing device.

In a further embodiment of the method steps a), b) and b') are part of an initial fitting process, and/or steps c) to h) are part of operating the hearing device during an evaluation (or trial) period.

In a further embodiment of the method at least one of:

indicating that the at least one second hearing device feature is currently being applied;

the control means for switching off and on an effect of the at least one second hearing device feature, is provided to the user by means of a separate, auxiliary device, such as for instance a remote control unit or a smartphone.

In a further embodiment of the method classifying the current hearing situation comprises determining different sound types and/or determining different connectivity settings, such as for instance determining whether the audio signal is derived from at least one microphone of the hearing device and/or from a (e.g. wireless) signal received by the hearing device. The connectivity settings for instance indicate whether the audio signal, e.g. originating from a telephone, a radio or television, is being streamed to the hearing device, e.g. via Bluetooth, or whether it is being picked-up by a microphone.

In a further embodiment the method further comprises the hearing device automatically switching on and off an effect of the at least one second hearing device feature, when the at least one second hearing device feature has been automatically selected and activated. In particular the control means are adapted such that when the hearing device automatically switched off the at least one second hearing device feature the at least one first hearing device feature is switched on, and when the hearing device automatically switches on the at least one second hearing device feature the at least one first hearing device feature is switched off. Switching off (or on) an effect of an advanced hearing device feature does not necessarily require disabling (or enabling) the feature entirely, but can for instance be achieved by changing parameter settings associated with the feature such that its effect is substantially reduced (or increased), e.g. by more than 50%, preferably by more than 90%, compared to the maximum achievable effect.

In a further embodiment the method further comprises requesting from the user a response indicative of the individual hearing benefit provided by the at least one second hearing device feature to the user.

In a further embodiment of the method as part of the step of requesting, the user is provided with one or more questions, for instance via a display on the auxiliary device or via the output transducer of the hearing device (e.g. in the form of speech).

In a further embodiment the method further comprises estimating a potential hearing benefit provided by the at least one second hearing device feature in the current hearing situation, if the at least one second hearing device feature is being applied, and not providing an indication to the user that the at least one second hearing device feature is being applied, if the estimated potential hearing benefit is below a certain per-determined threshold, said estimating in particular being based on analysing the activity (e.g. parameter settings) of appropriate actuators (e.g. of a beamformer, a noise canceller, a wind noise canceller, an occlusion canceller, etc.).

In a further embodiment of the method the auxiliary device monitors the current hearing situation, for instance based on a sound signal pick-up by the at least one microphone of the hearing device or a microphone located at the auxiliary device.

In a further embodiment the method further comprises determining if it is potentially disturbing to provide an indication to the user that the at least one second hearing device feature is being applied, based on information, such as the number of responses already (i.e. previously) provided by the user indicative of the individual hearing benefit provided by the at least one second hearing device feature, the time of day, calendar data, motion activity data, a circadian rhythm, or a biorhythm, in particular available to and/or determined by the auxiliary device, and not providing the indication to the user if it has been determined to be potentially disturbing.

In a further embodiment of the method as part of responding, the user inputs data into the hearing device or the auxiliary device, e.g. via a user interface, or provides a voice input, which is for instance picked-up by the microphone of the hearing device or a microphone of the auxiliary device.

In a further embodiment of the method the user response is stored as user response data in the hearing device or in the auxiliary device or transferred from the auxiliary device to a remote storage device such as a server, for instance cloud storage.

In a further embodiment of the method the at least one second, advanced hearing device feature is permanently turned off and/or prevented from being selected (or being applied) for processing the audio signal after a predetermined period of time, for instance after a number of weeks, during the evaluation period, i.e. the period of initially operating the hearing device.

In a further embodiment the method further comprises retrieving the user response data stored during the evaluation period, for instance from the hearing device or the auxiliary device or the remote storage device, by a fitting software or a client management software or a web application or an app running on the auxiliary device, such as an app for a smartphone.

In a further embodiment the method further comprises, in particular as part of a further fitting process, at least one of:

presenting an overview of the user response data stored during the evaluation period;

analysing the user response data stored during the evaluation period;

interpreting the user response data stored during the evaluation period;

determining an individual hearing benefit for the at least one second hearing device feature from the user response data associated with the at least one second hearing device feature from the user response data stored during the evaluation period.

In a further embodiment the method further comprises configuring the hearing device such that the at least one second, advanced hearing device feature is permanently removed or permanently deactivated, or conversely is made permanently available. In particular, configuring the hearing device is performed after the evaluation period.

In a further embodiment of the method configuring the hearing device is dependent on at least one of:

- the determined individual hearing benefit for the at least one second, advanced hearing device feature;
- a selection of the at least one second hearing device feature by an audiologist or the user of the hearing device, for instance in a fitting software or a client management software or a web application or an app running on the auxiliary device, such as an app for a smartphone;
- performing a financial transaction, for instance by the user;
- providing a passkey or an activation code to the hearing device.

In a further embodiment the method is part of a self-fitting or of an online fitting process.

In a further embodiment of the method the at least one second, advanced hearing device feature comprises one of:

- highly directive and/or adaptive beamforming;
- adaptive noise cancelling;
- wind noise cancelling;
- automatic occlusion cancelling;
- frequency transposition/compression;
- binaural processing, wherein the hearing device is worn at a left ear and a second hearing device is worn at a right ear of the user, such as:
  - providing the sound of a remote talker, e.g. originating from a far-end telephone, to the left and the right ear of the user;
  - binaural wind noise cancelling;
  - automatic listening, e.g. beamsteering, to the side or back when a relevant talker is detected there;
- providing many different, e.g. more than 3, automatically selectable hearing programs or signal processing configurations adapted for many different, e.g. more than 3, sound types or classes;
- audio streaming of at least one of a telephone, a television, a media player, a public address, and an alarm signal to the hearing device (e.g. providing a wireless headset functionality).

Examples of the first, basic hearing device features are for instance:

- hearing loss compensation in only a few, e.g. 1 to 3, frequency bands;
- noise cancelling for static background noise;
- static beamforming;
- feedback cancelling;
- providing only a few, e.g. 1 to 3, hearing programs (i.e. only a few, e.g. 1 to 3, different sound types or classes can be distinguished).

It is expressly pointed out that the above-mentioned embodiments can be arbitrarily combined to yield further specific embodiments of the method according to the present invention.

BRIEF DESCRIPTION OF THE DRAWINGS

The present invention will now be further illustrated by way of an exemplified embodiment shown in the accompanying drawing and described in detail in the following. It is pointed out that this embodiment is for illustrative purposes only and shall not limit the present invention as set out by the claims.

FIG. 1 shows a flow chart of an exemplary embodiment of the method according to the present invention.

DETAILED DESCRIPTION OF THE INVENTION

In FIG. 1 a flow chart of an exemplary embodiment of the present invention is illustrated. A potential customer (hearing device user) enters a hearing device store (@ step 10). An audiologist determines the user's hearing requirements for instance by measuring the user's audiogram (@ step 20). Based on the determined needs and personal preferences of the user a suitable hearing device model with an appropriate form factor is chosen (@ step 20). The audiologist performs a first fitting, i.e. he adjusts the hearing device settings according to the user's individual requirements (@ step 30). At this time all features supported by the chosen hearing device, i.e. both basic as well as advanced features, are made available to the user (@ step 20). Fine-tuning of the hearing device settings is performed so that a good initial acceptance of the hearing device is achieved while the user is still at the hearing device store, i.e. at the audiologist's/fitter's office (@ step 40). Subsequently, an appropriate app is downloaded to the user's smartphone or other auxiliary device such as a remote control unit (@ step 50). The smartphone is then paired with the user's hearing device(s), i.e. communication is established between the user's hearing device (s) and his smartphone. Following this, the user is instructed how to use his hearing device(s) as well as the app and sent home (@ step 70), where he uses his hearing device(s) in his individual real-life situations during an evaluation/trial period.

During initial use of the hearing device(s) during the evaluation period, a classifier determines the current hearing situation and dependent thereupon an advanced feature is selected and applied to processing the audio signal before being output via the loudspeaker of the hearing device. The hearing device informs the user via the app running on his smartphone that the advanced feature is presently active (@ step 80). The hearing device either actively sends this information to the smartphone or the app running on the smartphone periodically polls the hearing device for this information. The app then informs the user that he may currently experience the benefits of an advanced feature and asks if he wants to try it out (@ step 90). If the user wishes to do so, the app automatically toggles the advanced feature on and off a few times or the user does this manually (@ step 100). The app then asks the user if he experiences a benefit or not, e.g. by presenting a questionnaire to the user (@ step 100). The user's response, e.g. the user's answer to the questionnaire, is stored either in the hearing device(s), in the smartphone or remotely in a cloud storage (@ step 100). Specifically, the user's answer(s) is/are logged together with information regarding the advanced feature being demonstrated/evaluated.

After the evaluation/trial period, e.g. of a few weeks duration, the user returns to the hearing device store (@ step 110), where the audiologist retrieves the logged user responses from the hearing device(s), the smartphone or cloud storage, and subsequently analyses and interprets it (@ step 120). The audiologist then counsels the user about his usage of the advanced feature(s) and his experience thereof, and asks the user whether he wants to keep those advanced feature(s) where he had experienced a benefit (@ step 130). The user then chooses which advanced features he would like to be able to use in the future (@ step 140). The audiologist then e.g. configures the software of the hearing device such that the chosen advanced feature(s) are available to be employed once the classifier determines a hearing situation where it is appropriate to apply one of the chosen advanced features (@ step 150). It is thus ensured that the user leaves the hearing device store with a certainty that he has only acquired those advanced features that provide an actual benefit to him in his individual real-life hearing situations (@ step 160).

In a further embodiment of the method the app is configured with an ID (identification) generated by the fitting software, which is e.g. entered manually into the app, so that personal data entered into the app may be associated with user's fitting record in the database of the fitting software (or a database associated with the fitting software).

In a further embodiment of the method the app may upload logging data to cloud storage immediately as it becomes available or later on, e.g. when a free WiFi service is available, or upon user initiation.

In a further embodiment of the method the hearing device automatically detects situations where the benefits of an advanced feature are best experienced by observing the activity (e.g. parameter settings) of appropriate actuators (e.g. of a beamformer, noise cancellers, connectivity options) and informs the app and/or user directly, e.g. with an acoustical notification. Alternatively, the app may either observe the sound environment itself using a microphone of the smartphone and/or poll the hearing device regularly to detect a suitable moment to ask the user if he wants to try out an advanced feature now. The app may provide or have access to other data such as time of day, agenda data from a calendar, circadian rhythm to further determine an appropriate moment to ask the user for a response.

In a further embodiment of the method the user may manually try out benefits by switching features on and off at some suitable time for him. The app may then inform the user at such a moment if the advanced feature is currently in use and thus provides a potential benefit or not.

In a further embodiment the proposed method may be part of a (self-)fitting process, where the final buying decision and configuration of the hearing device with the user selected advanced features happens entirely via the app running on the smartphone without a PC-based fitting software being involved, in particular this process is performed online, e.g. via the Internet.

What is claimed is:

1. A method for evaluating an individual hearing benefit of a hearing device feature, comprising:

a) providing at least one first, basic hearing device feature in a hearing device;

b) providing at least one second, advanced hearing device feature in the hearing device;

c) automatically classifying a current hearing situation;

d) automatically selecting the at least one second, advanced hearing device feature dependent on the classified hearing situation;

e) applying the selected at least one second, advanced hearing device feature for processing an audio signal;

f) providing the processed audio signal to an output transducer of the hearing device;

g) estimating the potential hearing benefit of the at least one second, advanced hearing device feature;

h) notifying a user that the at least one second, advanced hearing device feature is currently being applied if an estimated potential hearing benefit is above a certain pre-determined threshold;

i) not notifying the user that the at least one second, advanced hearing device feature is being applied if the estimated potential hearing benefit is below the pre-determined threshold;

j) asking the user for confirmation to continue applying the at least one second, advanced hearing device feature; and k) upon receiving the confirmation, automatically switching off and on an effect of the at least one second, advanced hearing device and/or providing control means for the user to switch off and on an effect of the at least one second, advanced hearing device feature.

2. The method of claim 1, wherein at least one of:

indicating that the at least one second, advanced hearing device feature is currently being applied;

the control means for switching off and on an effect of the at least one second, advanced hearing device feature, is provided to the user by means of a separate, auxiliary device.

3. The method of claim 1, wherein classifying the current hearing situation comprises determining different sound types and/or determining different connectivity settings.

4. The method of claim 1, further comprising requesting from the user a response indicative of the individual hearing benefit provided by the at least one second, advanced hearing device feature to the user.

5. The method of claim 4, wherein as part of the step of requesting, the user is provided with one or more questions.

6. The method of claim 2, wherein the auxiliary device monitors the current hearing situation based on a sound signal pick-up by at least one microphone of the hearing device or a microphone located at the auxiliary device.

7. The method of claim 1, further comprising determining if it is potentially disturbing to provide an indication to the user if the at least one second, advanced hearing device feature has been selected, based on information available to and/or determined by the auxiliary device, and not providing the indication to the user if it has been determined to be potentially disturbing.

8. The method of claim 4, wherein as part of responding, the user inputs data into the hearing device or an auxiliary device which is picked-up by a microphone of the hearing device or a microphone of the auxiliary device.

9. The method of claim 4, wherein the user response is stored as user response data in the hearing device or in an auxiliary device or transferred from the auxiliary device to a remote storage device.

10. The method of claim 9, further comprising retrieving the user response data stored during initially operating the hearing device by a fitting software or a client management software or a web application or an app running on the-auxiliary device.

11. The method of claim 4, further comprising, as part of a further fitting process, at least one of:

presenting an overview of the user response data stored during initially operating the hearing device;

analysing the user response data stored during initially operating the hearing device;

interpreting the user response data stored during initially operating the hearing device;

determining an individual hearing benefit for the at least one second, advanced hearing device feature from the user response data associated with the at least one second, advanced hearing device feature from the user response data stored during initially operating the hearing device.

12. The method of claim 11, further comprising configuring the hearing device such that the at least one second, advanced hearing device feature is permanently removed or permanently deactivated or is made permanently available.

13. The method of claim 12, wherein configuring the hearing device is dependent on at least one of:

the determined individual hearing benefit for the at least one second, advanced hearing device feature;

a selection of the at least one second, advanced hearing device feature by an audiologist or the user of the hearing device in a fitting software or a client management software or a web application or an app running on the auxiliary device;

performing a financial transaction;

providing a passkey or an activation code to the hearing device.

14. The method of claim 1, wherein the method is part of a self-fitting or of an online fitting process.

15. The method of claim 1, wherein the at least one second, advanced hearing device feature comprises one of:

highly directive and/or adaptive beamforming;

adaptive noise cancelling;

wind noise cancelling;

automatic occlusion cancelling;

frequency transposition/compression;

binaural processing, wherein the hearing device is worn at a left ear and a second hearing device is worn at a right ear of the user providing more than 3 automatically selectable hearing programs or signal processing configurations adapted for more than 3 sound types or classes;

audio streaming of at least one of a telephone, a television, a media player, a public address, and an alarm signal to the hearing device.

16. The method of claim 1, wherein the hearing device automatically switches on and off an effect of the at least one second, advanced hearing device feature, when the at least one second hearing device feature has been automatically selected and activated.

17. The method of claim 1, wherein at least one second, advanced hearing device feature is permanently turned off or prevented from being applied for processing the audio signal after a predetermined period of time during an evaluation period.

18. The method of claim 7, wherein the information that is used to determine if providing an indication to the user is potentially disturbing is at least one of:

the number of responses already provided by the user indicating the individual hearing benefit from the at least one second hearing device feature;

time of day;

calendar data;

motion activity data;

a circadian rhythm;

a biorhythm.

* * * * *